US008985949B2

(12) United States Patent
Lee et al.

(10) Patent No.: US 8,985,949 B2
(45) Date of Patent: Mar. 24, 2015

(54) COOLING SYSTEM INCLUDING WAVY COOLING CHAMBER IN A TRAILING EDGE PORTION OF AN AIRFOIL ASSEMBLY

(71) Applicants: Ching-Pang Lee, Cincinnati, OH (US); Ralph W. Matthews, Oviedo, FL (US); Gm Salam Azad, Oviedo, FL (US); Manjit Shivanand, Winter Springs, FL (US)

(72) Inventors: Ching-Pang Lee, Cincinnati, OH (US); Ralph W. Matthews, Oviedo, FL (US); Gm Salam Azad, Oviedo, FL (US); Manjit Shivanand, Winter Springs, FL (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/872,229

(22) Filed: Apr. 29, 2013

(65) Prior Publication Data

US 2014/0321980 A1 Oct. 30, 2014

(51) Int. Cl.
*F01D 5/18* (2006.01)

(52) U.S. Cl.
CPC ..... *F01D 5/188* (2013.01); *F01D 5/186* (2013.01); *F05D 2250/183* (2013.01); *F01D 5/187* (2013.01); *F05D 2240/304* (2013.01); *F05D 2250/185* (2013.01); *F05D 2260/201* (2013.01); *F05D 2260/2212* (2013.01); *F05D 2260/22141* (2013.01); *F05D 2260/2214* (2013.01)
USPC ..... 416/97 R

(58) Field of Classification Search
CPC ..... F01D 5/18; F01D 5/186; F01D 5/187; F01D 5/188; F05D 2260/20; F05D 2260/202; F05D 2260/22141
USPC ..... 415/115, 116, 178; 416/95, 96 R, 97 R
See application file for complete search history.

(56) References Cited

U.S. PATENT DOCUMENTS

| | | | | |
|---|---|---|---|---|
| 4,474,532 | A | 10/1984 | Pazder | |
| 5,246,341 | A | 9/1993 | Hall et al. | |
| 5,370,499 | A | 12/1994 | Lee | |
| 5,464,322 | A | 11/1995 | Cunha et al. | |
| 5,468,125 | A * | 11/1995 | Okpara et al. | 416/97 R |
| 5,752,801 | A | 5/1998 | Kennedy | |
| 5,842,829 | A | 12/1998 | Cunha et al. | |
| 5,975,851 | A | 11/1999 | Liang | |
| 6,056,505 | A | 5/2000 | Cunha et al. | |
| 6,099,252 | A | 8/2000 | Manning et al. | |
| 6,183,194 | B1 | 2/2001 | Cunha et al. | |
| 6,254,334 | B1 | 7/2001 | LaFleur | |
| 6,325,593 | B1 | 12/2001 | Darkins, Jr. et al. | |
| 6,331,098 | B1 * | 12/2001 | Lee | 416/97 R |

(Continued)

OTHER PUBLICATIONS

Ching-Pang Lee et al.; U.S. Appl. No. 13/228,567, filed Sep. 9, 2011; entitled "Trailing Edge Cooling System in a Turbine Airfoil Assembly".

*Primary Examiner* — Nathaniel Wiehe
*Assistant Examiner* — Michael Sehn

(57) ABSTRACT

An airfoil in a gas turbine engine includes an outer wall, a cooling fluid cavity, and a cooling system. The outer wall has a leading edge, a trailing edge, a pressure side, a suction side, and radially inner and outer ends. The cooling fluid cavity is defined in the outer wall, extends generally radially between the inner and outer ends of the outer wall, and receives cooling fluid for cooling the outer wall. The cooling system receives cooling fluid from the cooling fluid cavity for cooling the trailing edge portion of the outer wall and includes a cooling fluid chamber defined by opposing first and second sidewalls that include respective alternating angled sections that provide the cooling fluid chamber with a zigzag shape.

18 Claims, 6 Drawing Sheets

(56) References Cited

U.S. PATENT DOCUMENTS

| | | | | |
|---|---|---|---|---|
| 6,402,470 | B1 | 6/2002 | Kvasnak et al. | |
| 6,499,949 | B2 | 12/2002 | Schafrik et al. | |
| 6,607,356 | B2 * | 8/2003 | Manning et al. | 416/97 R |
| 6,616,406 | B2 | 9/2003 | Liang | |
| 6,902,372 | B2 | 6/2005 | Liang | |
| 6,932,573 | B2 | 8/2005 | Liang | |
| 6,984,102 | B2 | 1/2006 | Bunker et al. | |
| 6,997,675 | B2 * | 2/2006 | Dube et al. | 415/115 |
| 7,066,716 | B2 | 6/2006 | Jacala et al. | |
| 7,182,576 | B2 | 2/2007 | Bunker et al. | |
| 7,186,084 | B2 | 3/2007 | Bunker et al. | |
| 7,270,515 | B2 | 9/2007 | Liang | |
| 7,293,961 | B2 | 11/2007 | Lee et al. | |
| 7,413,407 | B2 * | 8/2008 | Liang | 416/97 R |
| 7,435,053 | B2 | 10/2008 | Liang | |
| 7,438,527 | B2 | 10/2008 | Albert et al. | |
| 7,452,186 | B2 | 11/2008 | Charbonneau et al. | |
| 7,549,844 | B2 | 6/2009 | Liang | |
| 7,670,113 | B1 | 3/2010 | Liang | |
| 7,753,650 | B1 | 7/2010 | Liang | |
| 7,780,414 | B1 * | 8/2010 | Liang | 416/97 R |
| 7,780,415 | B2 | 8/2010 | Liang | |
| 7,785,070 | B2 | 8/2010 | Liang | |
| 7,785,071 | B1 * | 8/2010 | Liang | 416/97 R |
| 7,806,659 | B1 | 10/2010 | Liang | |
| 7,857,589 | B1 * | 12/2010 | Liang | 416/97 R |
| 8,052,378 | B2 * | 11/2011 | Draper | 415/115 |
| 8,092,175 | B2 * | 1/2012 | Beeck et al. | 416/95 |
| 2005/0226726 | A1 | 10/2005 | Lee et al. | |
| 2005/0281673 | A1 | 12/2005 | Draper et al. | |
| 2008/0286115 | A1 | 11/2008 | Liang | |

* cited by examiner 14
18B
18D
30B
30A
30C
40
34
2
2
30
48
52
44
70
20A
48
52
44
$R_D$
20
54
28
46
50
12
22
26
18
10
22A
80
78
76
72
18A
16
74
74

COOLING SYSTEM INCLUDING WAVY COOLING CHAMBER IN A TRAILING EDGE PORTION OF AN AIRFOIL ASSEMBLY

FIELD OF THE INVENTION

The present invention relates to a cooling system in a turbine engine, and more particularly, to a cooling system including a wavy cooling chamber for cooling a trailing edge portion of an airfoil assembly.

BACKGROUND OF THE INVENTION

In gas turbine engines, compressed air discharged from a compressor section and fuel introduced from a source of fuel are mixed together and burned in a combustion section, creating combustion products defining a high temperature working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoil assemblies, e.g., stationary vanes and rotating blades within the turbine section, must be cooled with cooling fluid, such as air discharged from a compressor in the compressor section, to prevent overheating of the components.

SUMMARY OF THE INVENTION

In accordance with a first aspect of the present invention, an airfoil is provided in a gas turbine engine. The airfoil comprises an outer wall, a cooling fluid cavity, and a cooling system. The outer wall comprises a leading edge portion including a leading edge, a trailing edge portion including a trailing edge, a pressure side, a suction side, a radially inner end, and a radially outer end. A chordal direction is defined between the leading and trailing edges and a radial direction is defined between the radially inner and outer ends. The cooling fluid cavity is defined in the outer wall and receives cooling fluid for cooling the outer wall. The cooling system receives cooling fluid from the cooling fluid cavity for cooling the trailing edge portion of the outer wall and comprises a plurality of radially spaced-apart first impingement channels extending generally in the chordal direction from the cooling fluid cavity to a first cooling fluid chamber for delivering cooling fluid from the cooling fluid cavity to the first cooling fluid chamber. The cooling system further comprises a plurality of radially spaced-apart second impingement channels extending generally in the chordal direction from the first cooling fluid chamber to a second cooling fluid chamber for delivering cooling fluid from the first cooling fluid chamber to the second cooling fluid chamber. The cooling system still further comprises a plurality of radially spaced-apart third impingement channels extending generally in the chordal direction from the second cooling fluid chamber to a third cooling fluid chamber for delivering cooling fluid from the second cooling fluid chamber to the third cooling fluid chamber. The third cooling fluid chamber is defined by opposing first and second sidewalls comprising respective alternating angled sections that provide the third cooling fluid chamber with a zigzag shape.

In accordance with a second aspect of the present invention, an airfoil assembly is provided in a gas turbine engine.

The airfoil assembly comprises a platform assembly and an airfoil comprising an outer wall, a cooling fluid cavity, and a cooling system. The outer wall is coupled to the platform assembly and comprises a leading edge portion including a leading edge, a trailing edge portion including a trailing edge, a pressure side, a suction side, a radially inner end, and a radially outer end. A chordal direction is defined between the leading and trailing edges and a radial direction is defined between the radially inner and outer ends. The cooling fluid cavity is defined in the outer wall and receives cooling fluid from the platform assembly for cooling the outer wall. The cooling system receives cooling fluid from the cooling fluid cavity for cooling the trailing edge portion of the outer wall and comprises a plurality of radially spaced-apart first impingement channels extending generally in the chordal direction from the cooling fluid cavity to a first cooling fluid chamber for delivering cooling fluid from the cooling fluid cavity to the first cooling fluid chamber. The first cooling fluid chamber has a direction of elongation in the radial direction. The cooling system further comprises a plurality of radially spaced-apart second impingement channels extending generally in the chordal direction from the first cooling fluid chamber to a second cooling fluid chamber for delivering cooling fluid from the first cooling fluid chamber to the second cooling fluid chamber. The second cooling fluid chamber has a direction of elongation in the radial direction. The cooling system still further comprises a plurality of radially spaced-apart third impingement channels extending generally in the chordal direction from the second cooling fluid chamber to a third cooling fluid chamber for delivering cooling fluid from the second cooling fluid chamber to the third cooling fluid chamber. The third cooling fluid chamber has a direction of elongation in the radial direction and is defined by opposing first and second sidewalls that comprise respective alternating angled sections that provide the third cooling fluid chamber with a zigzag shape when viewed from a radially outer side of the cooling system. The cooling system additionally comprises a plurality of outlet passages extending from the third cooling fluid chamber to the trailing edge of the outer wall. The outlet passages receive cooling fluid from the third cooling fluid chamber and discharge the cooling fluid from the airfoil.

BRIEF DESCRIPTION OF THE DRAWINGS

Although the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
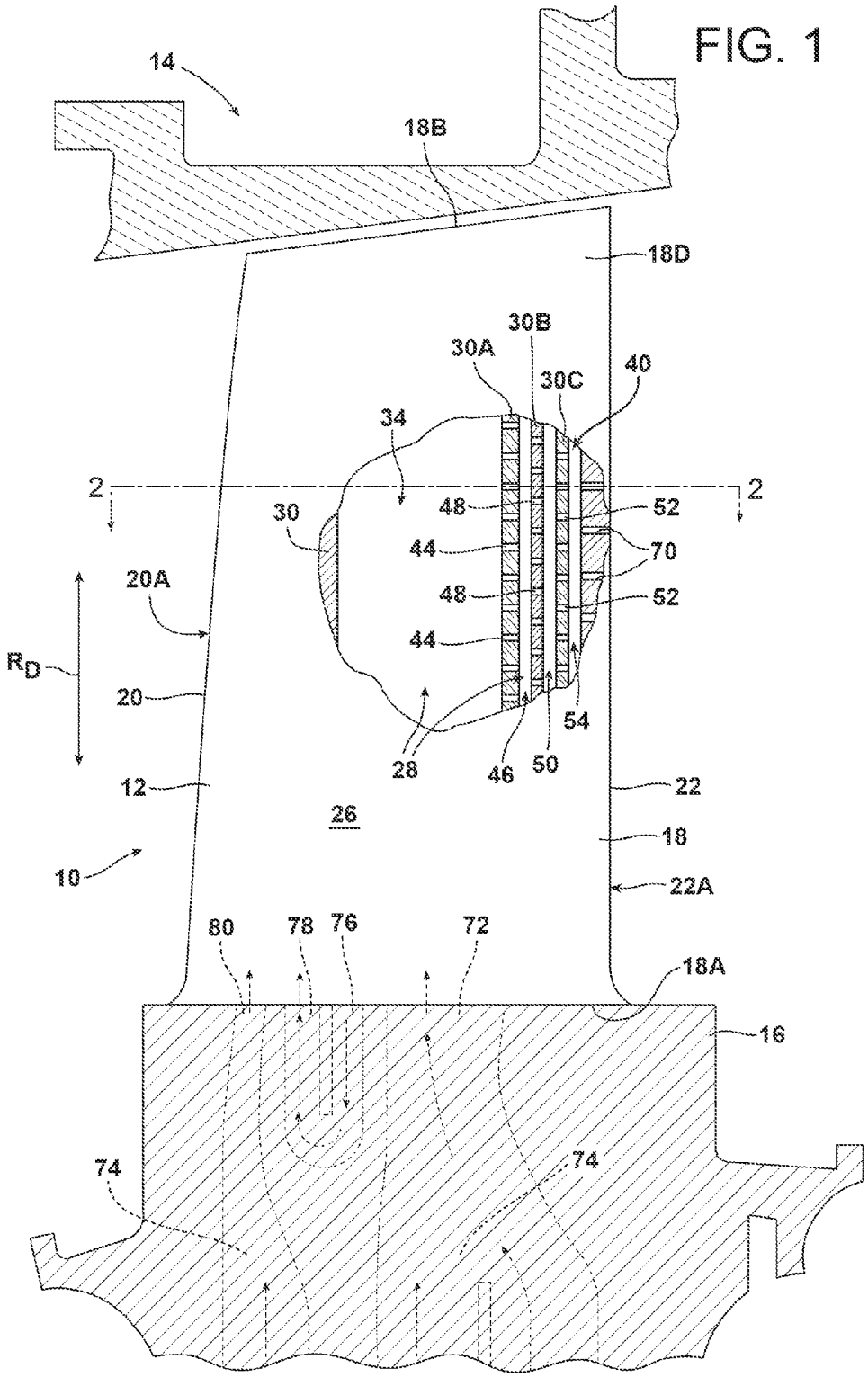
FIG. 1 is a side cross-sectional view of an airfoil assembly including a cooling system according to an embodiment of the invention, wherein a portion of a suction side of the airfoil assembly has been removed.

Referring now to FIG. 1, an airfoil assembly 10 constructed in accordance with an embodiment of the present invention is illustrated. In the illustrated embodiment, the airfoil assembly 10 is a blade assembly comprising an airfoil, i.e., a rotatable blade 12, although it is understood that the cooling concepts disclosed herein could be used in combination with a stationary vane. The airfoil assembly 10 is for use in a turbine section 14 of a gas turbine engine.

As will be apparent to those skilled in the art, the gas turbine engine includes a compressor section (not shown), a combustor section (not shown), and the turbine section 14. The compressor section includes a compressor that compresses ambient air, at least a portion of which is conveyed to the combustor section. The combustor section includes one or more combustors that mix the compressed air from the compressor section with a fuel and ignite the mixture creating combustion products defining a high temperature working gas. The high temperature working gas travels to the turbine section 14 where the working gas passes through one or more turbine stages, each turbine stage comprising a row of stationary vanes and a row of rotating blades 12. It is contemplated that the airfoil assembly 10 illustrated in FIG. 1 may be included in a first row of rotating blade assemblies in the turbine section 14.

The vane and blade assemblies in the turbine section 14 are exposed to the high temperature working gas as the working gas passes through the turbine section 14. Cooling air, e.g., from the compressor section, may be provided to cool the vane and blade assemblies, as will be described herein.

As shown in FIG. 1, the airfoil assembly 10 comprises the blade 12 and a platform assembly 16 that is coupled to a turbine rotor (not shown) and to which the blade 12 is affixed. The blade 12 comprises an outer wall 18 (see also FIG. 2) that is affixed at a radially inner end 18A thereof to the platform assembly 16.

Figure 2:
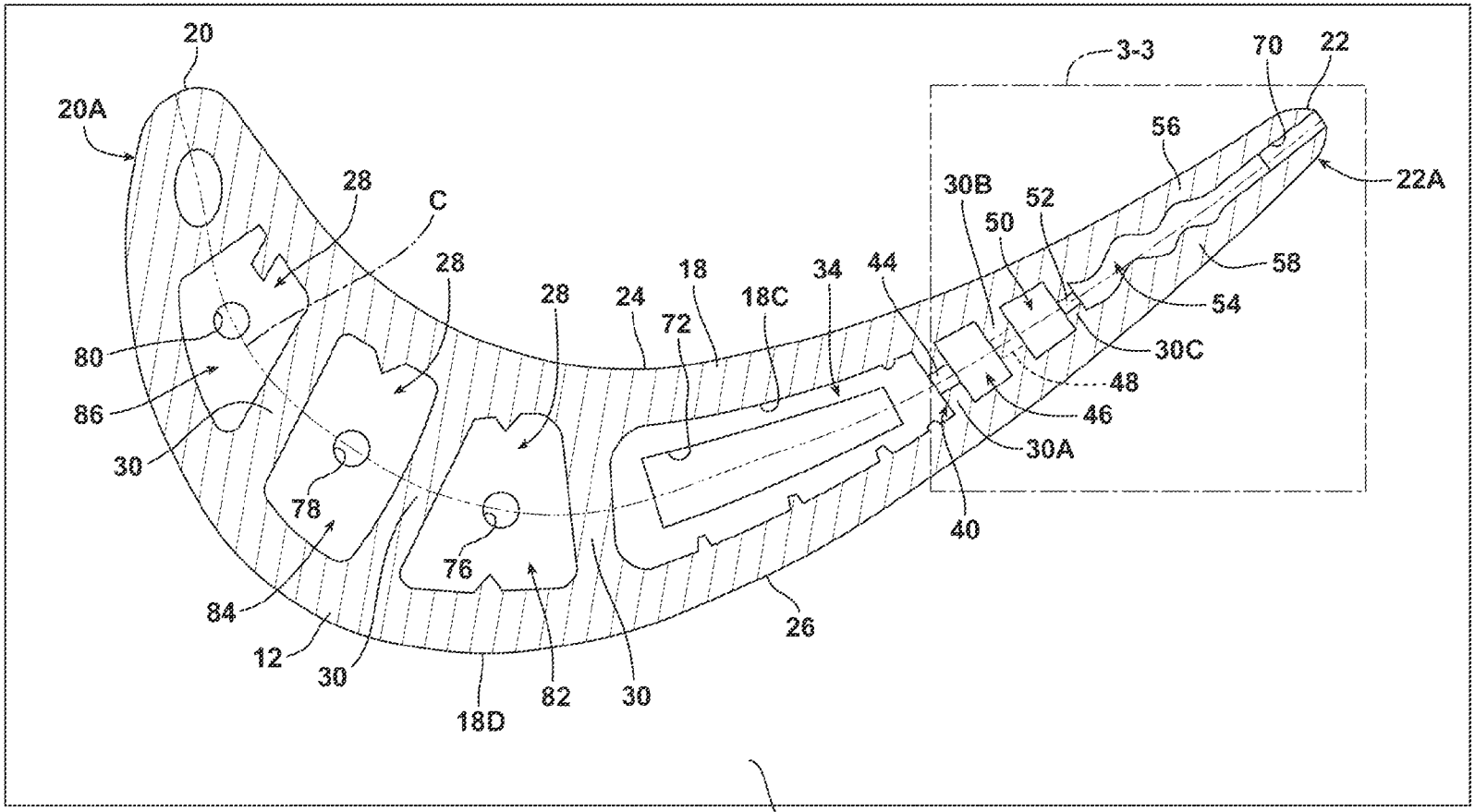
FIG. 2 is cross-sectional view taken along line 2-2 in FIG. 1.

Referring to FIGS. 1 and 2, the outer wall 18 comprises a leading edge portion 20A including a leading edge 20, a trailing edge portion 22A including a trailing edge 22 spaced from the leading edge 20 in a chordal direction C, a concave-shaped pressure side 24, a convex-shaped suction side 26, the radially inner end 18A, and a radially outer end 18B, wherein a spanwise or radial direction $R_D$ is defined between the inner and outer ends 18A, 18B. It is noted that a portion of the suction side 26 of the blade 12 illustrated in FIG. 1 has been removed to show selected internal structures within the blade 12, which will be described herein.

As shown in FIG. 2, an inner surface 18C of the outer wall 18 defines a hollow interior portion 28 extending between the pressure and suction sides 24, 26 from the leading edge portion 20A to the trailing edge portion 22A and from the inner end 18A to the outer end 18B. A plurality of rigid spanning structures 30 extend within the hollow interior portion 28 from the pressure side 24 to the suction side 26 and from the inner end 18A to the outer end 18B to provide structural rigidity for the blade 12 and to divide the hollow interior portion 28 into a plurality of sections, which will be described below. The spanning structures 30 may be formed integrally with the outer wall 18. A conventional thermal barrier coating (not shown) may be provided on an outer surface 18D of the outer wall 18 to increase the heat resistance of the blade 12, as will be apparent to those skilled in the art.

As shown in FIGS. 1 and 2, a cooling fluid cavity 34 is defined in the outer wall 18 between the pressure and suction sides 24, 26. The cooling fluid cavity 34 is located in the hollow interior portion 28 of the outer wall 18 and extends generally radially between the inner and outer ends 18A, 18B of the outer wall 18. The cooling fluid cavity 34 receives cooling fluid from the platform assembly 16 for cooling the trailing edge portion 22A of the outer wall 18, as will be described below.

In accordance with the present invention, the airfoil assembly 10 is provided with a cooling system 40 for effecting cooling of the trailing edge portion 22A of the blade 12. As noted above, while the description of the cooling system 40 herein pertains to a blade assembly, it is contemplated that the concepts of the cooling system 40 of the present invention could be incorporated into a vane assembly.

Figure 3:
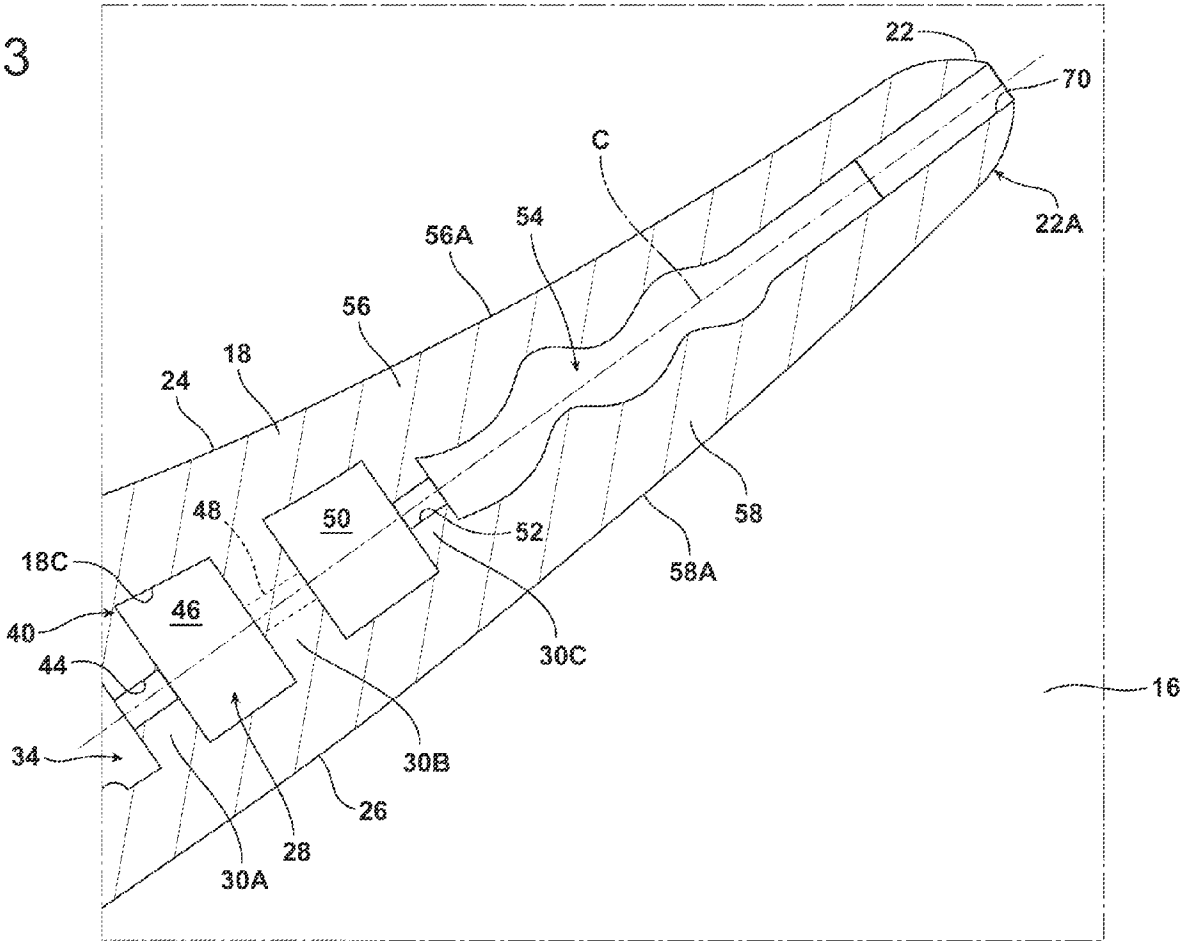
FIG. 3 is an enlarged cross-sectional view of section 3-3 from FIG. 2.

As shown in FIGS. 1-3, the cooling system 40 is located in the hollow interior portion 28 of the outer wall 18 near the trailing edge portion 22A. The cooling system 40 comprises a plurality of radially spaced-apart first impingement channels 44 that extend generally in the chordal direction through a first one 30A of the spanning structures. The first impingement channels 44 are in fluid communication with the cooling fluid cavity 34 and provide cooling fluid from the cooling fluid cavity 34 to a first cooling fluid chamber 46. As shown in FIG. 1, the first cooling fluid chamber 46 has a direction of elongation in the radial direction $R_D$ and extends from the radially inner end 18A to the radially outer end 18B of the outer wall 18 in the embodiment shown, although the first cooling fluid chamber 46 need not extend all the way to the inner and outer ends 18A, 18B of the outer wall 18.

The cooling system 40 further comprises a plurality of radially spaced-apart second impingement channels 48 that extend generally in the chordal direction through a second one 30B of the spanning structures. The second impingement channels 48 are in fluid communication with the first cooling fluid chamber 46 and provide cooling fluid from the first cooling fluid chamber 46 to a second cooling fluid chamber 50. As shown in FIG. 1, the second cooling fluid chamber 50 has a direction of elongation in the radial direction $R_D$ and extends from the radially inner end 18A to the radially outer end 18B of the outer wall 18 in the embodiment shown, although the second cooling fluid chamber 50 need not extend all the way to the inner and outer ends 18A, 18B of the outer wall 18.

The cooling system 40 still further comprises a plurality of radially spaced-apart third impingement channels 52 that extend generally in the chordal direction through a third one 30C of the spanning structures. The third impingement channels 52 are in fluid communication with the second cooling fluid chamber 50 and provide cooling fluid from the second cooling fluid chamber 50 to a third cooling fluid chamber 54. Referring to FIG. 1, the third cooling fluid chamber 54 has a direction of elongation in the radial direction $R_D$ and extends from the radially inner end 18A to the radially outer end 18B of the outer wall 18 in the embodiment shown, although the third cooling fluid chamber 54 need not extend all the way to the inner and outer ends 18A, 18B of the outer wall 18.

As shown most clearly in FIG. 3, the third cooling fluid chamber 54 is defined by opposing first and second sidewalls 56, 58, which sidewalls 56, 58 in the embodiment shown are portions of the outer wall 18 that have outer surfaces 56A, 58A that define respective sections of the pressure and suction sides 24, 26 of the outer wall 18.

Figure 3A:
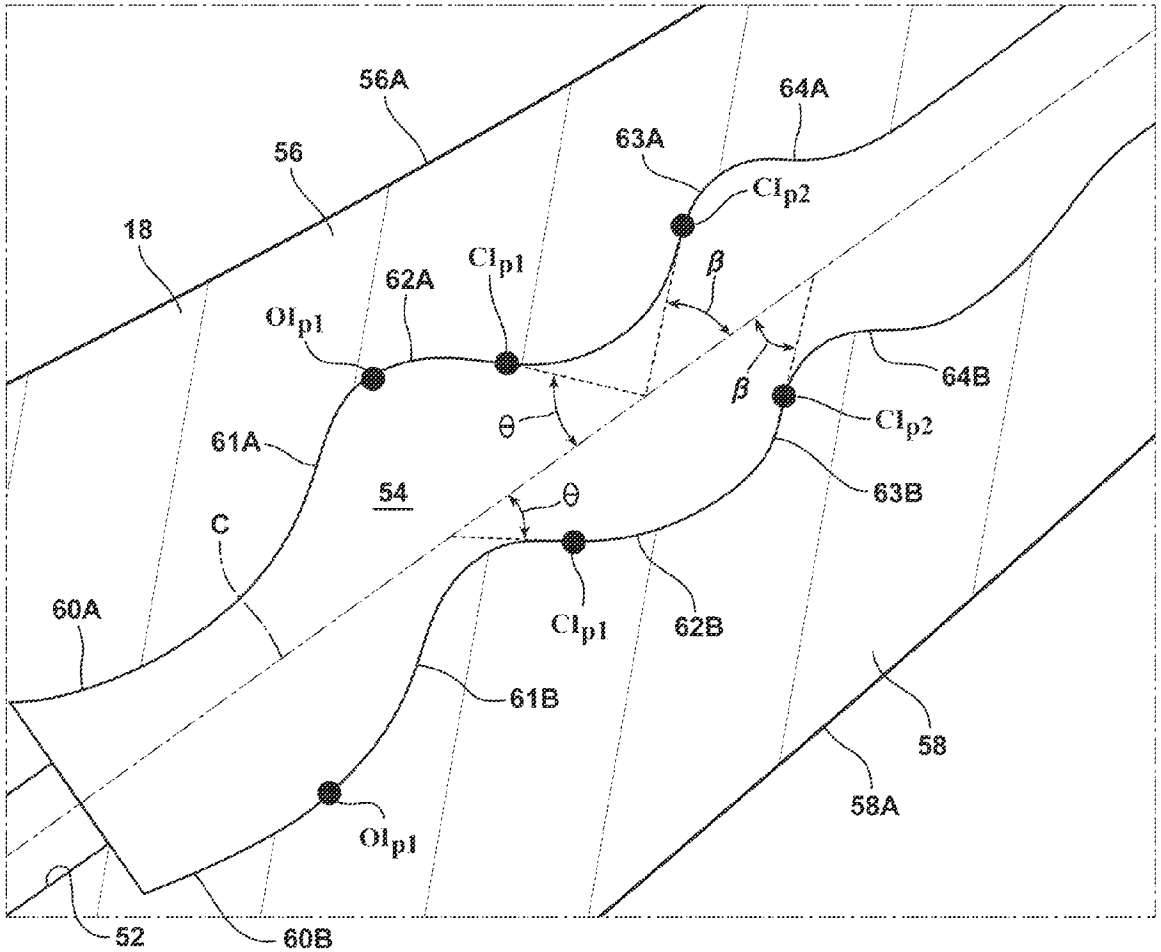
FIG. 3A is an enlarged portion of FIG. 3 to show details of the cooling system.

Referring to FIG. 3A, the first and second sidewalls 56, 58 that define the third cooling fluid chamber 54 comprise respective alternating angled sections 60A, 61A, 62A, 63A, 64A and 60B, 61B, 62B, 63B, 64B that are angled toward the respective suction and pressure sides 24, 26 of the outer wall 18 and provide the third cooling fluid chamber 54 with a wavy or zigzag shape when viewed from a radially outer side of the cooling system 40, i.e., as shown in FIGS. 2, 3, and 3A. As discussed herein, the even numbered sections, i.e., sections 60A, 60B, 62A, 62B, 64A, 64B, are referred to as "first sections" that are angled toward the suction side 26 of the outer wall 18, and the odd numbered sections, i.e., sections 61A, 61B, 63A, 63B, are referred to as "second sections" that are angled toward the pressure side 24 of the outer wall 18. It is noted that while the first sections are angled toward the suction side 26 of the outer wall 18 and the second sections are angled toward the pressure side 24 of the outer wall 18 the first sections could be angled toward the pressure side 24 and the second sections could be angled toward the suction side 26.

As shown in FIG. 3A, angles θ of the respective first sections taken with respect to the chordal direction C, as measured from respective central inflection points $CI_{p1}$ of the first sections, may be substantially equal and opposite to angles β of the respective second sections taken with respect to the chordal direction C, as measured from respective central inflection points $CI_{p2}$ of the second sections. The angles θ of the first sections are preferably within a range of about (15) to about (60) degrees relative to the chordal direction C, and the angles β of the second sections are preferably with a range about (−15) to about (−60) degrees relative to the chordal direction C. Further, opposed angled sections 60A and 60B, 61A and 61B, 62A and 62B, 63A and 63B, 64A and 64B of the respective first and second sidewalls 56, 58 are generally parallel to one another and define outer inflection points $OI_{p1}$, $OI_{p2}$ at apices thereof.

Although the turns between the adjacent first and second sections of each of the first and second sidewalls 56, 58 in the embodiment shown comprise continuously curved walls, the turns could be defined by relatively sharp intersecting angles or by generally linear wall portions with rounded corners at the turns. The continuously curved turns in the embodiment shown effect a turning of the cooling fluid passing through the third cooling fluid chamber 54 and also provide a boundary layer restart for the cooling fluid, resulting in more flow turbulence and higher heat transfer through the third cooling fluid chamber 54.

Moreover, while the first and second sidewalls 56, 58 in the embodiment shown each comprise a total of five alternating angled sections 60-64A, 60-64B, additional or fewer alternating angled sections may be provided. However, the first and second sidewalls 56, 58 according to an aspect of the present invention comprise at least a first section angled toward one of the pressure side 24 and the suction side 26 of the outer wall 18 in a downstream direction of cooling fluid flow through the cooling system 40, and at least a second section extending from the first section and angled toward the other of the pressure side 24 and the suction side 26 of the outer wall 18 in the downstream direction.

Referring back to FIG. 1, the first and second impingement channels 44, 48 are preferably radially offset with respect to one another, and the second and third impingement channels 48, 52 are also preferably radially offset with respect to one another. Hence, cooling fluid passing out of the first and second impingement channels 44, 48 strikes against respective radially facing surfaces of the second and third spanning structures 30B, 30C to provide impingement cooling thereto, as will be discussed further below. The first impingement channels 44 may be generally radially aligned with the third impingement channels 52 as shown in FIG. 1, or the first impingement channels 44 may be radially offset from the third impingement channels 52.

The cooling system 40 further comprises a plurality of radially spaced-apart outlet passages 70 extending from the third cooling fluid chamber 54 to the trailing edge 22 of the outer wall 18, see FIGS. 1-3. The outlet passages 70 receive cooling fluid from the third cooling fluid chamber 54 and discharge the cooling fluid from the blade 12, i.e., the cooling fluid exits the blade 12 of the airfoil assembly 10 via the outlet passages 70. The cooling fluid is then mixed with the hot working gas passing through the turbine section 14. The outlet passages 70 may be located along substantially the entire radial length of the outer wall 18, or may be selectively located along the trailing edge 22 to fine tune cooling provided to specific areas.

Referring now to FIGS. 1 and 2, the platform assembly 16 includes an opening 72 formed therein in communication with the cooling fluid cavity 34. The opening 72 allows cooling fluid to pass from a cooling supply 74 (see FIG. 1) provided in the platform assembly 16 into the cooling fluid cavity 34. The cooling supply 74 may receive cooling fluid, such as compressor discharge air, as is conventionally known in the art.

A portion of the cooling fluid flowing through the cooling fluid cavity 34 flows toward the radially outer end 18B of the outer wall 18 where it passes through an opening (not shown) and into a second cooling fluid cavity 82, see FIG. 2. This portion of cooling fluid provides convective cooling to the blade 12 as it flows radially inwardly through the second cooling fluid cavity 82. Upon reaching the radially inner end 18A of the outer wall 18 within the second cooling fluid cavity 82, this portion of cooling fluid flows through an additional opening 76 in the platform 16, then makes a 180-degree turn and passes through another opening 78 in the platform 16, see FIG. 1. This cooling fluid then flows radially outwardly through a third cooling fluid cavity 84 so as to provide additional convective cooling to the blade 12, see FIG. 2. This portion of cooling fluid is then discharged from the blade 12 in any conventional manner, such as, for example, via an outlet (not shown) at the radially outer end 18B of the outer wall 18.

The platform assembly 16 may be provided with an additional opening 80 (see FIGS. 1 and 2) that supplies cooling fluid to a leading edge cavity 86 (see FIG. 2). Cooling fluid is provided from the cooling supply 74 in the platform assembly 16 into the leading edge cavity 86 to provide cooling to the leading edge portion 20A of the blade 12, as will be apparent to those skilled in the art.

During operation, cooling fluid is provided to the cooling supply 74 in the platform assembly 16 in any known manner, as will be apparent to those skilled in the art. The cooling fluid passes from the cooling supply 74 into the cooling fluid cavity 34 via the opening 72 and into the leading edge cavity 86 via the opening 80, see FIGS. 1 and 2.

The cooling fluid passing into the cooling fluid cavity 34 flows radially outwardly through the cooling fluid cavity 34. Portions of the cooling fluid flow into the first impingement channels 44 of the cooling system 40, and an additional portion of the cooling fluid flows into the second cooling fluid cavity 82 as described above.

The first impingement channels 44 provide metering of the cooling fluid, wherein the cooling fluid provides convective cooling to the blade 12 while passing through the first impingement channels 44. The cooling fluid is discharged from the first impingement channels 44 into the first cooling fluid chamber 46, wherein the cooling fluid provides impingement cooling to the radially facing surface of the second spanning structure 30B as mentioned above. The cooling fluid also provides convective cooling to the blade 12 while flowing within the first cooling fluid chamber 46.

The cooling fluid then flows into the second impingement channels 48, which provide additional metering of the cooling fluid, wherein the cooling fluid provides convective cooling to the blade 12 while passing through the second impingement channels 48. The cooling fluid is discharged from the second impingement channels 48 into the second cooling fluid chamber 50, wherein the cooling fluid provides impingement cooling to the radially facing surface of the third spanning structure 30C as mentioned above. The cooling fluid also provides convective cooling to the blade 12 while flowing within the second cooling fluid chamber 50.

The cooling fluid then flows into the third impingement channels 52, which provide further metering of the cooling fluid, wherein the cooling fluid provides convective cooling to the blade 12 while passing through the third impingement channels 52. The cooling fluid is discharged from the third impingement channels 52 into the third cooling fluid chamber 54.

Due to the configuration of the third cooling fluid chamber 54, i.e., due to the alternating angled sections 60-64A, 60-64B of the first and second sidewalls 56, 58, the effective length of the third cooling fluid chamber 54 is increased, as opposed to a cooling fluid chamber defined by generally planar sidewalls. Hence, the effective surface area of the first and second sidewalls 56, 58 that define the third cooling fluid chamber 54 is increased, so as to increase cooling to the outer wall 18 provided by the cooling fluid passing through the third cooling fluid chamber 54, again, as opposed to a cooling fluid chamber defined by generally planar sidewalls. The cooling fluid provides convective cooling for the outer wall 18 of the blade 12 at the trailing edge portion 22A as it flows within the third cooling fluid chamber 54, and also provides impingement cooling to the sidewalls 56, 58 as a result of striking against the alternating angled sections 60-64A, 60-64B after passing the turns between the first and second sections of each of the first and second sidewalls 56, 58.

The cooling fluid then flows from the third cooling fluid chamber 54 into the outlet passages 70, wherein the cooling fluid provides additional convective cooling for the outer wall 18 of the blade 12 at the trailing edge 22 as it flows out of the blade 12 through the outlet passages 70. It is noted that the diameters of the outlet passages 70 may be sized so as to meter the cooling fluid passing out of the cooling system 40. It is further noted that each outlet passage 70 may have the same diameter size, or outlet passages 70 located at select radial locations may have different sized diameters so as to fine tune cooling provided to the outer wall 18 at the corresponding radial locations.

According to one aspect of the invention, the cooling system 40 may be formed using a sacrificial ceramic core (not shown), which is dissolved or melted to form the voids that define the respective portions of the cooling system 40. Alternatively, the cooling system 40 may be formed by other suitable methods.

Figure 4A:
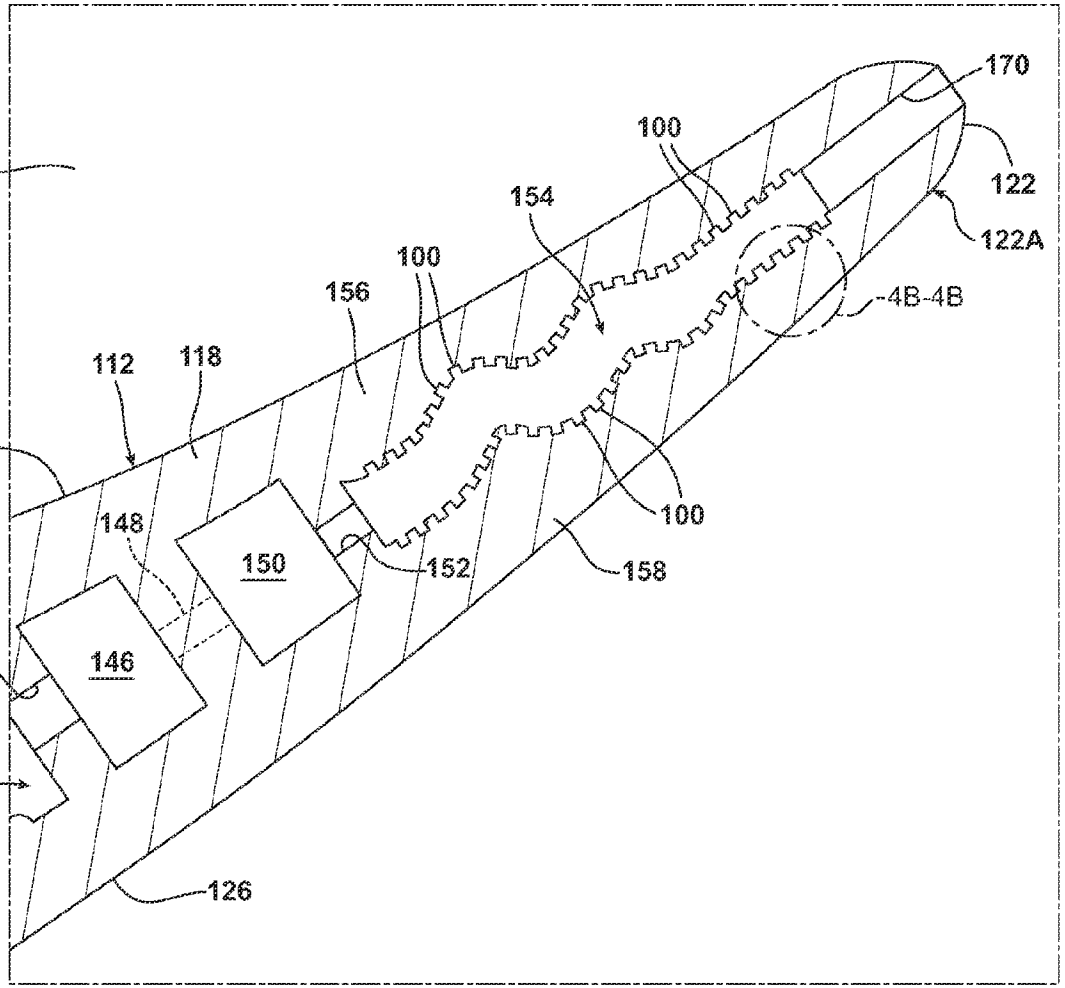
FIG. 4A is an enlarged cross-sectional view similar to FIG. 3 and showing a portion of a cooling system for an airfoil assembly according to another embodiment of the invention.
Figure 4B:
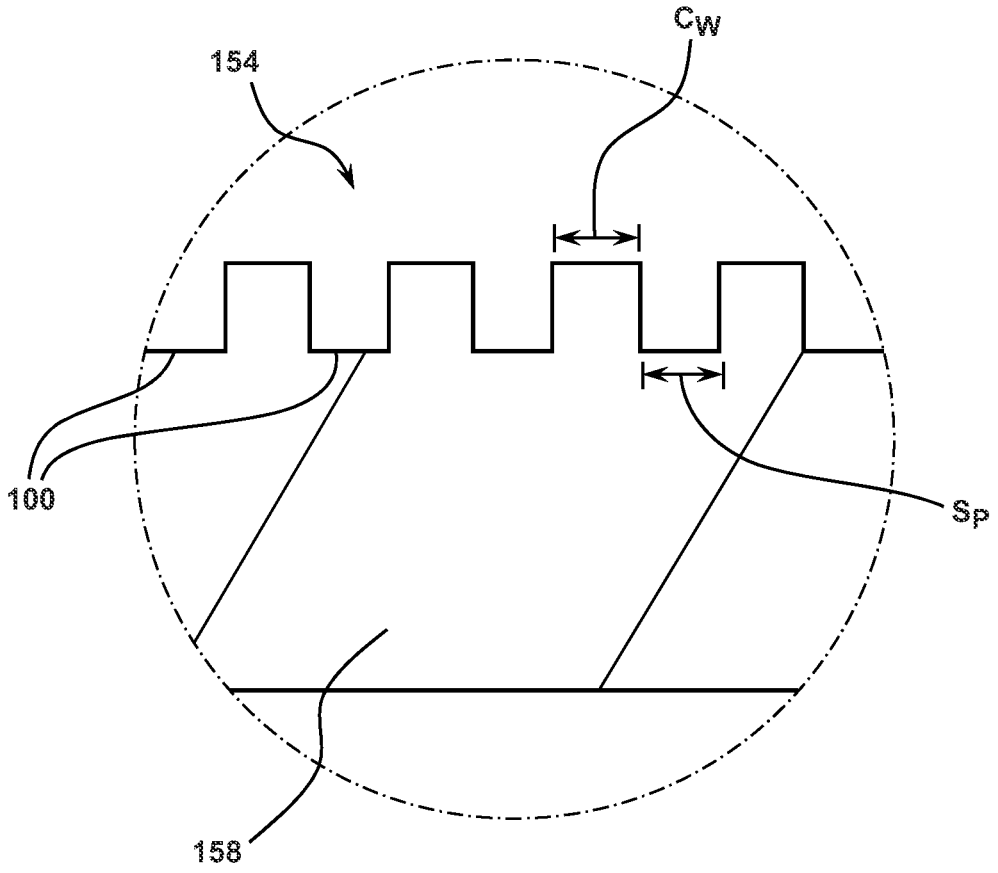
FIG. 4B is an enlarged cross-sectional view of section 4B-4B from FIG. 4A.

Referring to FIG. 4A, a portion of a blade 112 of an airfoil assembly 110 according to another aspect of the invention is shown, wherein structure similar to that described above with reference to FIGS. 1-3A includes the same reference number increased by 100. According to this aspect of the invention, turbulating features 100 comprising grooves in the embodiment shown are formed in the first and second sidewalls 156, 158. As clearly shown in FIG. 4A and as shown in more detail in FIG. 4B, a chordal spacing $S_P$ between adjacent turbulating features 100 is generally equal to or less than a chordal width $C_W$ of the turbulating features 100. The turbulating features 100 effect a turbulation of cooling fluid flowing through the third cooling fluid chamber 154 so as to increase cooling provided to the outer wall 118. It is noted that other types of turbulating features than grooves could be used, such as elongate ribs or small bumps or dimples formed in the sidewalls 156, 158.

What is claimed is:

1. An airfoil in a gas turbine engine comprising:

an outer wall comprising a leading edge portion including a leading edge, a trailing edge portion including a trailing edge, a pressure side, a suction side, a radially inner end, and a radially outer end, wherein a chordal direction is defined between the leading and trailing edges and a radial direction is defined between the radially inner and outer ends;

a cooling fluid cavity defined in the outer wall, the cooling fluid cavity receiving cooling fluid for cooling the outer wall; and a cooling system that receives cooling fluid from the cooling fluid cavity for cooling the trailing edge portion of the outer wall, the cooling system comprising:

a plurality of radially spaced-apart first impingement channels extending generally in the chordal direction from the cooling fluid cavity to a first cooling fluid chamber for delivering cooling fluid from the cooling fluid cavity to the first cooling fluid chamber;

a plurality of radially spaced-apart second impingement channels extending generally in the chordal direction from the first cooling fluid chamber to a second cooling fluid chamber for delivering cooling fluid from the first cooling fluid chamber to the second cooling fluid chamber; and a plurality of radially spaced-apart third impingement channels extending generally in the chordal direction from the second cooling fluid chamber to a third cooling fluid chamber for delivering cooling fluid from the second cooling fluid chamber to the third cooling fluid chamber, the third cooling fluid chamber being defined by opposing first and second sidewalls comprising respective alternating angled sections that provide the third cooling fluid chamber with a zigzag shape and comprising a plurality of turbulating features provided within the third cooling fluid chamber, the turbulating features effecting a turbulated flow of cooling fluid through the third cooling fluid chamber and being formed in the first and second sidewalls such that a chordal spacing between adjacent turbulating features is substantially equal to or less than a chordal width of the turbulating features.

2. The airfoil according to claim 1, wherein the first, second, and third cooling fluid chambers each have a direction of elongation in the radial direction.

3. The airfoil according to claim 1, further comprising a plurality of outlet passages extending from the third cooling fluid chamber to the trailing edge of the outer wall, the outlet passages receiving cooling fluid from the third cooling fluid chamber and discharging the cooling fluid from the airfoil.

4. The airfoil according to claim 1, wherein the alternating angled sections of the first and second sidewalls that define the third cooling fluid chamber comprise at least a first section angled toward one of the pressure side and the suction side of the outer wall in a downstream direction and at least a second section extending from the first section and angled toward the other of the pressure side and the suction side of the outer wall in the downstream direction.

5. The airfoil according to claim 4, wherein the angles of the second sections are substantially equal and opposite to the angles of the first sections and the first and second sidewalls are continuously curved.

6. The airfoil according to claim 5, wherein the angles of the first sections are within a range of about (15) to about (60) degrees relative to the chordal direction, and the angles of the second sections are with a range about (−15) to about (−60) degrees relative to the chordal direction.

7. The airfoil according to claim 4, wherein opposed angled sections of the respective first and second sidewalls are generally parallel to one another and define inflection points at apices thereof.

8. The airfoil according to claim 1, wherein the cooling fluid cavity extends generally radially between the inner and outer ends of the outer wall.

9. The airfoil according to claim 1, wherein the first and second impingement channels are radially offset with respect to one another.

10. The airfoil according to claim 9, wherein the second and third impingement channels are radially offset with respect to one another.

11. The airfoil according to claim 10, wherein the first impingement channels are generally radially aligned with the third impingement channels.

12. The airfoil according to claim 1, wherein the first and second sidewalls that define the third cooling fluid chamber have outer surfaces that define respective portions of the pressure and suction sides of the outer wall.

13. The airfoil according to claim 1, wherein a dimension of the third cooling fluid chamber in the circumferential direction is greater than a dimension of the radially spaced-apart third impingement channels in the circumferential direction.

14. An airfoil assembly in a gas turbine engine comprising:

a platform assembly; and an airfoil comprising:

an outer wall coupled to the platform assembly and comprising a leading edge portion including a leading edge, a trailing edge portion including a trailing edge, a pressure side, a suction side, a radially inner end, and a radially outer end, wherein a chordal direction is defined between the leading and trailing edges and a radial direction is defined between the radially inner and outer ends;

a cooling fluid cavity defined in the outer wall, the cooling fluid cavity receiving cooling fluid from the platform assembly for cooling the outer wall; and a cooling system that receives cooling fluid from the cooling fluid cavity for cooling the trailing edge portion of the outer wall, the cooling system comprising:

a plurality of radially spaced-apart first impingement channels extending generally in the chordal direction from the cooling fluid cavity to a first cooling fluid chamber for delivering cooling fluid from the cooling fluid cavity to the first cooling fluid chamber, the first cooling fluid chamber having a direction of elongation in the radial direction;

a plurality of radially spaced-apart second impingement channels extending generally in the chordal direction from the first cooling fluid chamber to a second cooling fluid chamber for delivering cooling fluid from the first cooling fluid chamber to the second cooling fluid chamber, the second cooling fluid chamber having a direction of elongation in the radial direction;

a plurality of radially spaced-apart third impingement channels extending generally in the chordal direction from the second cooling fluid chamber to a third cooling fluid chamber for delivering cooling fluid from the second cooling fluid chamber to the third cooling fluid chamber, the third cooling fluid chamber having a direction of elongation in the radial direction and being defined by opposing first and second sidewalls comprising respective alternating angled sections that provide the third cooling fluid chamber with a zigzag shape when viewed from a radially outer side of the cooling system;

a plurality of outlet passages extending from the third cooling fluid chamber to the trailing edge of the outer wall, the outlet passages receiving cooling fluid from the third cooling fluid chamber and discharging the cooling fluid from the airfoil; and a plurality of turbulating features provided within the third cooling fluid chamber, the turbulating features effecting a turbulated flow of cooling fluid through the third cooling fluid chamber, wherein the turbulating features are formed in the first and second sidewalls such that a chordal spacing between adjacent turbulating features is substantially equal to or less than a chordal width of the turbulating features.

15. The airfoil assembly according to claim 14, wherein:

the alternating angled sections of the sidewalls that define the third cooling fluid chamber comprise at least a first section angled toward one of the pressure side and the suction side of the outer wall in a downstream direction and at least a second section extending from the first section and angled toward the other of the pressure side and the suction side of the outer wall in the downstream direction; and the opposing angled sections of the respective first and second sidewalls are generally parallel to one another and define inflection points at apices thereof.

16. The airfoil assembly according to claim 15, wherein:

the angles of the second sections are substantially equal and opposite to the angles of the first sections; and turns between adjacent sections of each of the first and second sidewalls comprise continuously curved walls.

17. The airfoil assembly according to claim 14, wherein:

the first and second impingement channels are radially offset with respect to one another; and the second and third impingement channels are radially offset with respect to one another.

18. The airfoil assembly according to claim 14, wherein the first and second sidewalls that define the third cooling fluid chamber have outer surfaces that define respective portions of the pressure and suction sides of the outer wall.

* * * * *